US009282394B1

(12) United States Patent
Clark

(10) Patent No.: US 9,282,394 B1
(45) Date of Patent: Mar. 8, 2016

(54) HIGH PERFORMANCE AUDIO HEADPHONES AND SPEAKER DEVICES

(71) Applicant: Dan W. Clark, San Diego, CA (US)

(72) Inventor: Dan W. Clark, San Diego, CA (US)

(73) Assignee: Mr Speakers, LLC, San Diego, CA (US)

( * ) Notice: Subject to any disclaimer, the term of this patent is extended or adjusted under 35 U.S.C. 154(b) by 0 days.

(21) Appl. No.: 14/452,240

(22) Filed: Aug. 5, 2014

Related U.S. Application Data

(60) Provisional application No. 61/862,387, filed on Aug. 5, 2013.

(51) Int. Cl.
*H04R 25/00* (2006.01)
*H04R 1/10* (2006.01)

(52) U.S. Cl.
CPC ..... *H04R 1/1058* (2013.01)

(58) Field of Classification Search
CPC ..... H04R 1/1058; H04R 1/10; H04R 1/1041; H04R 1/28; H04R 1/1008
USPC ..... 381/371, 373
See application file for complete search history.

(56) References Cited

U.S. PATENT DOCUMENTS 4,529,057 A * 7/1985 Telford ..... A61F 11/14 128/868
2010/0232636 A1 * 9/2010 Lin et al. ..... 381/370

FOREIGN PATENT DOCUMENTS

CN 203387652 * 1/2014

* cited by examiner

*Primary Examiner* — Tuan D Nguyen
(74) *Attorney, Agent, or Firm* — Steven C. Tietsworth, Esq.

(57) ABSTRACT

A headphone may include a driver assembly and a headphone cup having an adjustable airflow valve assembly and/or an adjustable headphone interior cup volume adjustment assembly. Headphone cups and/or other elements may be printed with a 3D printer, and may be tailored to a particular headphone driver element.

10 Claims, 10 Drawing Sheets

HIGH PERFORMANCE AUDIO HEADPHONES AND SPEAKER DEVICES

CROSS-REFERENCE TO RELATED APPLICATIONS

This application claims priority under 35 U.S.C. §119(e) to U.S. Provisional Patent Application Ser. No. 61/862,387, entitled HIGH PERFORMANCE AUDIO HEADPHONE AND SPEAKER DEVICES, filed Aug. 5, 2013, the content of which is incorporated by reference herein in its entirety for all purposes.

FIELD

This disclosure relates generally to high performance audio headphone and speaker devices and methods of making such devices. More specifically, but not exclusively, the disclosure relates to high performance audio headphones and loudspeakers which use adjustable airflow valves and/or volumetric adjustment mechanisms to tune system performance.

BACKGROUND

Audio headphones are well known in the art. Existing headphones have typically been developed to meet specific cost/price targets. As a result, headphones offered at low to moderate prices are not carefully designed or tuned in such a manner as to optimize their acoustic performance. This is particularly problematic when the headphone is "closed" or "semi-closed," with a cup or similar structure encircling and fully or partially containing a volume behind the audio driver. In these devices, an improperly executed design typically allows the cup to act as an echo chamber, smearing the time domain response of the system and resulting in unpleasant, high distortion audio with significant non-linearity in the frequency response and a characteristic "closed" sound. These distortions reduce the fidelity and quality of the sound presented to a listener.

Conventional headphone and speaker enclosures are designed with a fixed volume intended to optimize performance for a "perfect" driver. However, loudspeakers and headphone transducers may have a wide range of operating parameters that stray from the optimum design point and may underperform when installed in an enclosure optimized for a specific set of operating parameters.

Accordingly, there is a need in the art to address the above-described, as well as other, problems so as to provide higher quality sound in a low to moderately priced headphone or speaker device.

SUMMARY

This disclosure relates generally to high performance audio headphone and speaker devices and methods of making such devices. More specifically, but not exclusively, the disclosure relates to high performance audio headphones and loudspeakers which use adjustable airflow valves and/or volumetric adjustment mechanisms to tune system performance.

Various additional aspects, features, and functionality are further described below in conjunction with the appended Drawings.

BRIEF DESCRIPTION OF THE DRAWINGS

The present disclosure may be more fully appreciated in connection with the following detailed description taken in conjunction with the accompanying drawings, wherein.

DETAILED DESCRIPTION

Overview

Figure 1A:
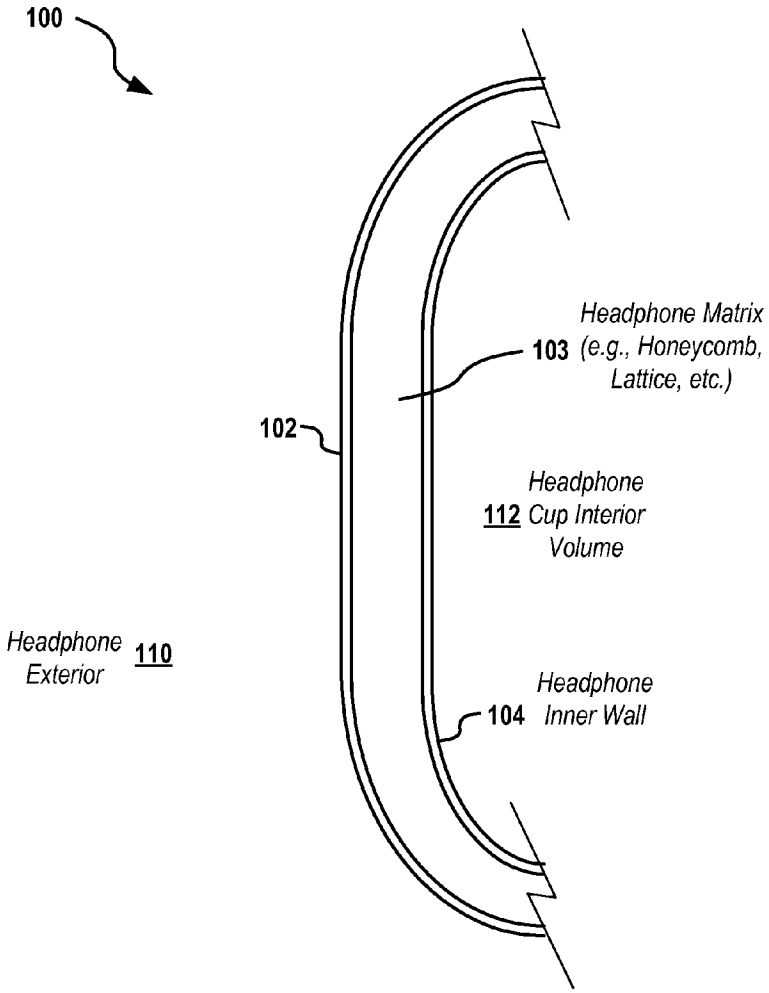
FIG. 1A illustrates details of a headphone cup embodiment including an outer wall, an inner wall, and a matrix between the outer wall and inner wall.

This disclosure relates generally to high performance audio headphone and speaker devices. More specifically, but not exclusively, the disclosure relates to high performance audio headphones and loudspeakers which use adjustable airflow valves and/or volumetric adjustment mechanisms to tune system performance.

Details of headphone or speaker devices as described in this disclosure may be combined in various embodiments with the disclosures of co-assigned patent applications including U.S. Utility patent application Ser. No. 13/921,387, entitled HIGH PERFORMANCE AUDIO HEADPHONES, filed on Jun. 19, 2013, U.S. Provisional Patent Application Ser. No. 61/661,761, entitled HIGH PERFORMANCE AUDIO HEADPHONES AND METHODS FOR MAKING AND MODIFYING HEADPHONES TO ENHANCE PERFORMANCE, filed on Jun. 19, 2012, U.S. Provisional Patent Application Ser. No. 61/708,626, entitled HIGH PERFORMANCE AUDIO HEADPHONES AND METHODS FOR MAKING AND MODIFYING HEADPHONES TO ENHANCE PERFORMANCE, filed on Oct. 1, 2012, and U.S. Provisional Patent Application Ser. No. 61/761,660, entitled HIGH PERFORMANCE AUDIO HEADPHONES AND METHODS FOR MAKING AND MODIFYING HEADPHONES TO ENHANCE PERFORMANCE, filed on Feb. 6, 2013. The content of each of these applications is incorporated by reference herein in its entirety for all purposes.

Additional details of various aspects are further described below.

EXAMPLE EMBODIMENTS

It is noted that as used herein, the term, "exemplary" means "serving as an example, instance, or illustration." Any aspect, detail, function, implementation, and/or embodiment described herein as "exemplary" is not necessarily to be construed as preferred or advantageous over other aspects and/or embodiments.

In various embodiments, headphone cups may be configured as described subsequently in various permutations and combinations. In conventional headphones, the cups (and other elements) are made using injection molding of plastics or milling or metal, wood, or other materials. These configurations use a single layer of material for the cups, which may be disadvantageous.

In one aspect, which may be applied to headphones as well as other audio devices, such as loudspeakers, a dual-wall design may be used. For example, headphone cups may include an outer wall, an inner wall, and a matrix in between. The matrix may, for example, be in a honeycomb or other lattice material to increase isolation. Such a configuration may also be used to increase rigidity, which may reduce resonance and vibration. In some embodiments, 3D printing may be used to fabricate the cups using either a single material with different structural volumes or using multiple materials, with different materials used for the outer wall, matrix, and/or inner wall. 3D printing may be used for cup inner walls, outer walls, and/or additional headphone or speaker elements. 3D printed elements may be elements having multiple layers that may be finished with chemical or mechanical polishing and may be painted, epoxied, coated with additional materials, and/or otherwise processed subsequent to the basis 3D printing step.

Turning to the drawings, FIG. 1A illustrates details of a cutaway of a headphone cup 100. As shown, the cup may be fabricated with an outer wall 102, in contact with the exterior 110, a matrix 103, which may be a honeycomb, lattice, insulating material such as fiberglass, etc., and an inner wall 104, in contact with the headphone interior volume 112. Additional structural elements, such as cross-bracing, electronics, electro-acoustic elements, and additional areas of the headphones are omitted from FIG. 1A for clarity but may be included in various embodiments.

In another aspect, which may be implemented alone or in various combinations with the details described herein in different embodiments, an adjustable airflow valve assembly may be included in the cup or in contact with the interior headphone volume to control airflow between the exterior of the headphone and an interior volume, such as the headphone cup interior volume.

In an exemplary embodiment, an adjustable airflow valve assembly may include an adjustable screw inset into the headphone cup wall to allow precise regulation of airflow between the cup and the external environment. This may be a continuously adjustable valve or other adjustment mechanism. In some embodiments this control may alternately be step adjustable, such as through use of multiple adjustment steps. Electronic controls of volume may be used in some embodiments, such as through use of an electromagnetic or other electronically adjustable valve elements, or the valve may be mechanically controlled, such as by a user.

By opening and closing an aperture controlled by or in contact with the screw, the impedance and mass of the air in the cup may be adjusted to control frequency response (e.g., to modify bass amplitude), balance bass between channels, adjust the Q of the headphones, and the like. In prior art configurations, single or multiple holes plugged by screws or other removable objects have been used to serve this function. This configuration allows only discrete adjustments, and also frequently results in users' losing small parts essential to system performance. By including an adjustable valve embedded with the cup itself, more precise and continuously variable adjustments may be provided and potential for lost-parts reduced. A vent or other outlet across the adjustable valve aperture may also be covered, in whole or in part, with a fabric material to further tune the headphones. Different fabrics may be used to tune affected frequencies, such as by selecting a fabric to attenuate low frequencies or high frequencies.

Figure 1D:
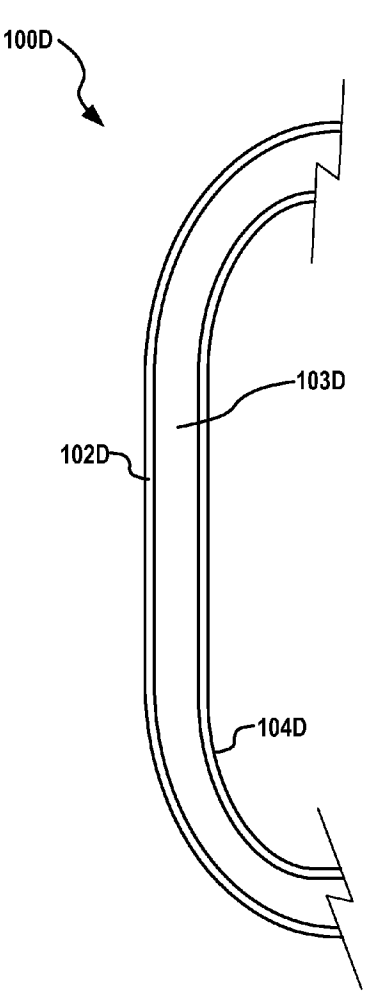
FIGS. 1B-D illustrate details of headphone cup embodiments with different wall configurations to achieve desired volumes associated with different drivers.
Figure 1C:
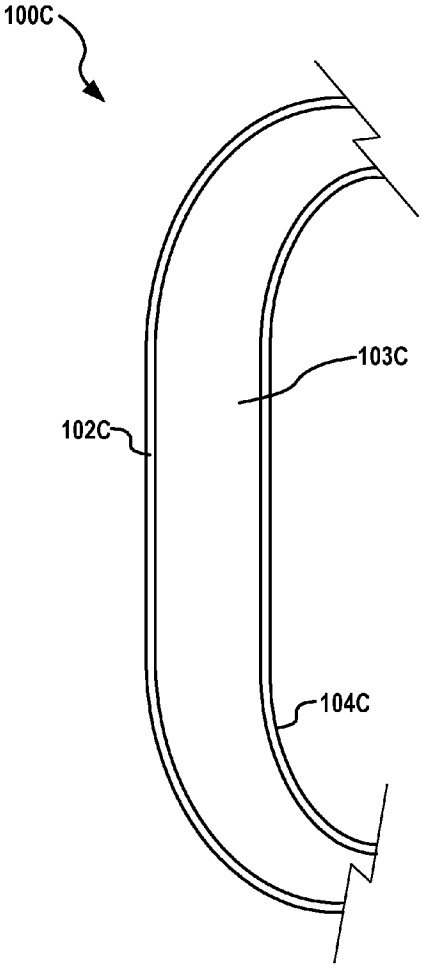
Figure 1B:
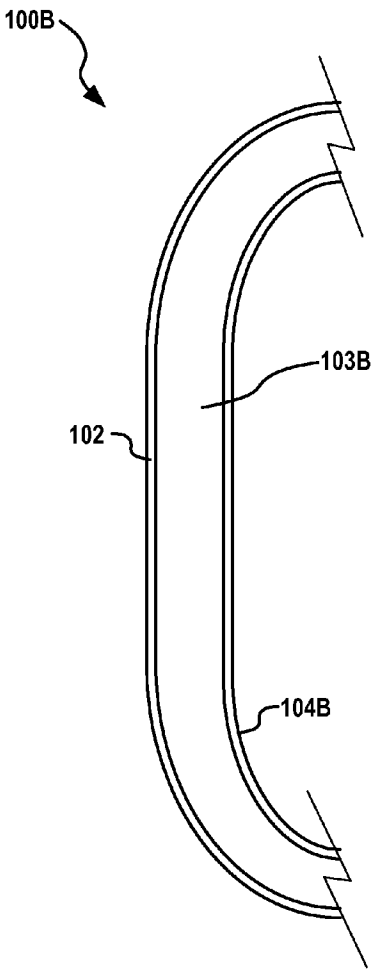

FIGS. 1B-D illustrate the use of 3D printing technology to create dynamically tuned interior volumes using printed inner and/or outer shells with printing layers to custom optimize enclosure volume to each and every driver. In various embodiments, inner shells, outer shells, and/or other headphone components may be printed on a 3D printer, in whole or in part. The printed shells may then be polished or otherwise smoothed, such as with a chemical polish such as acetone or other materials, and/or via mechanical polishing methods using abrasives, polishing compounds, buffers, and the like to achieve a desired finish. In some embodiments a highly polished glossy finish may be used, whereas in others, matte or other finishes may be used. In addition, in some embodiments, custom images, graphics, symbols, and/or other features may be printed on the outer surface of the headphone walls, cups, or other elements, and/or on the interior or within the headphone elements.

For example, in FIG. 1B printed shells 103B and 104B are shown, and their relative positioning can be varied as shown in FIGS. 1C and 1D, such as by moving the inner wall or shell element 104 away from or toward the outer wall or shell element 102. For example, utilizing a lookup table or algorithms, a loudspeaker or headphone driver may be measured, and based on results a specific enclosure shape or volume can be designed or modified, such as on a 3D computer-based CAD program or other electronic design tool, via a 3D scanner, or otherwise converted to a 3D printable file format and then sent to a printer and printed to match the driver. The shaping may also be variably adjusted through mechanical, electromagnetic, or other adjustment mechanisms in some embodiments. In some embodiments, multiple shell or cup elements may be provided so as to allow a user to custom tailor the headphone or speaker to a particularly desired feature, such as resonance at selected frequencies and the like.

Shapes and/or volumetric changes can be implemented, for example, moving the inner wall 104 so as to increase (as shown in FIG. 1C as wall 104C relative to wall 102C) a greater distance than as shown in wall 103B of FIG. 1B, or decrease (as shown in FIG. 1D as wall 104D relative to wall 102D) the chamber volume, by printing a specifically sized cup assembly 100, or by changing the shape or geometry of the inner wall 104 to optimize performance. In some embodiments the outer wall shape and/or positioning may also be modified, either alone or in combination with modification to the inner wall shape and/or positioning.

Figures 9A, 9B, 9C:
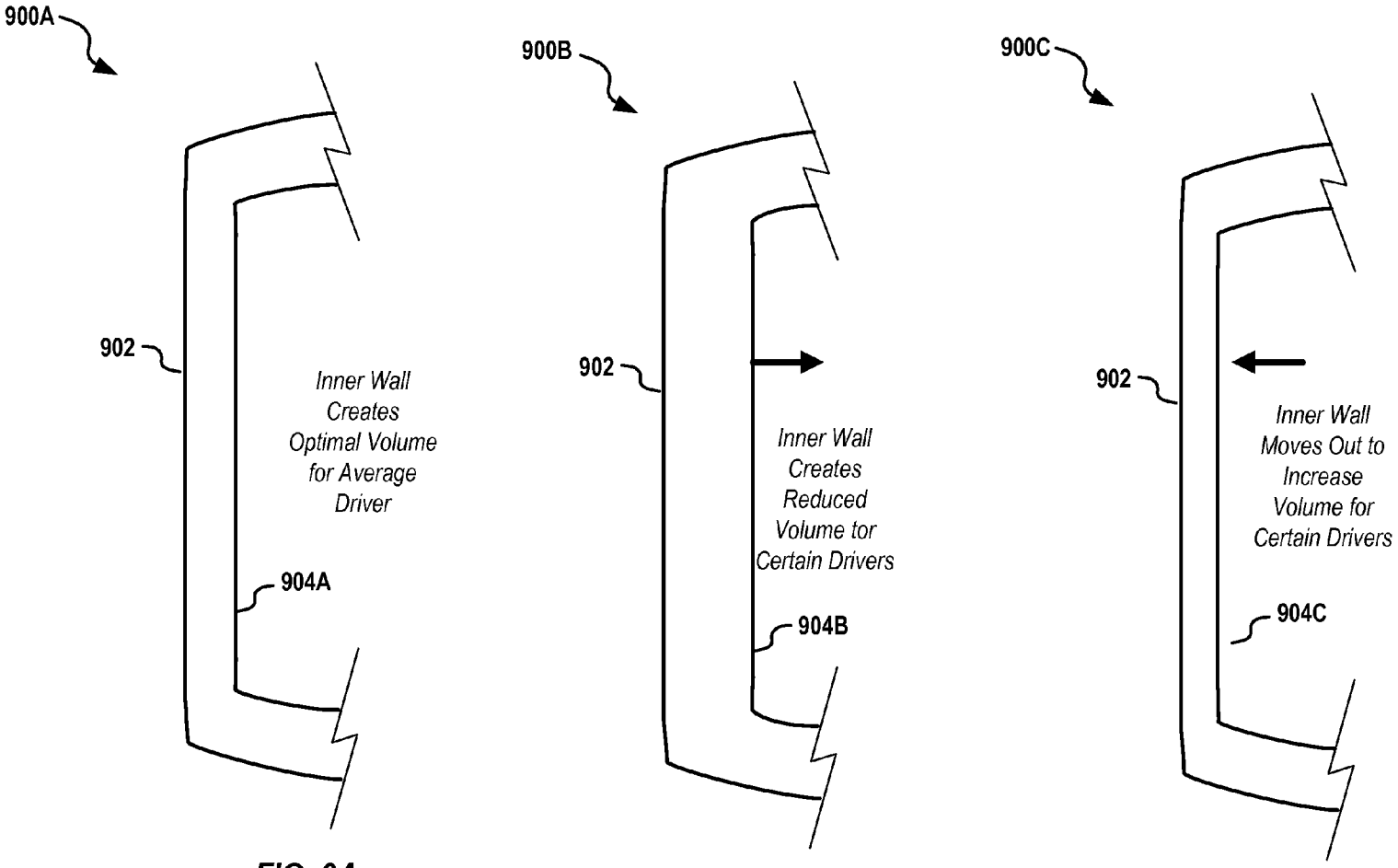
FIGS. 9A-C illustrate details of headphone cup embodiments with variable wall configurations to achieve desired volumes associated with different drivers.

FIGS. 9A-C similarly illustrate details of headphone cup embodiments with different wall configurations to achieve desired volumes associated with different drivers. For example, in FIG. 9A a standard or average wall shape and positioning may be used based on an average or typical driver, with inner wall 904A positioned at a standard distance from outer wall 902. In FIG. 9B, for certain drivers, it may be desirable to reduce the inner cup volume, which may be done by moving the positioning of inner wall 904B away from outer wall 902 and/or changing its shape (not shown) so as to reduce the volume. FIG. 9C shows another embodiment wherein the cup volume is increased by moving the inner wall 904C towards the outer wall 902 (and/or changing its shape, not shown). These may be implemented in an adjustable fashion, such as with electronic or mechanical adjustment elements such as actuators, screws, and the like to allow a user to custom tailor the cup, or it may be tailored upon manufacture for a particular driver or electronics.

In particular, it is to be understood that the various wall configurations may be independently manufactured and may be custom-tailored to a particular driver or for other parameters in various embodiments, such as by providing a user-customized headphone with 3D printed elements. Alternatively, the configurations may be adjusted on-demand during use (e.g., by a component that moves the inner wall, such as by threaded screws, sliders, electronically via motors or other electromagnetic elements, or using other wall adjustment mechanical elements as known or developed in the art). Either implementation allows custom-tuned enclosure volumes to mate with a specific driver where the driver is measured, then either a specific cup is printed to mate the driver from a list/table of pre-defined cup sizes, an algorithm is used to modify the cup interior on the fly, or some other method is followed.

Figure 2C:
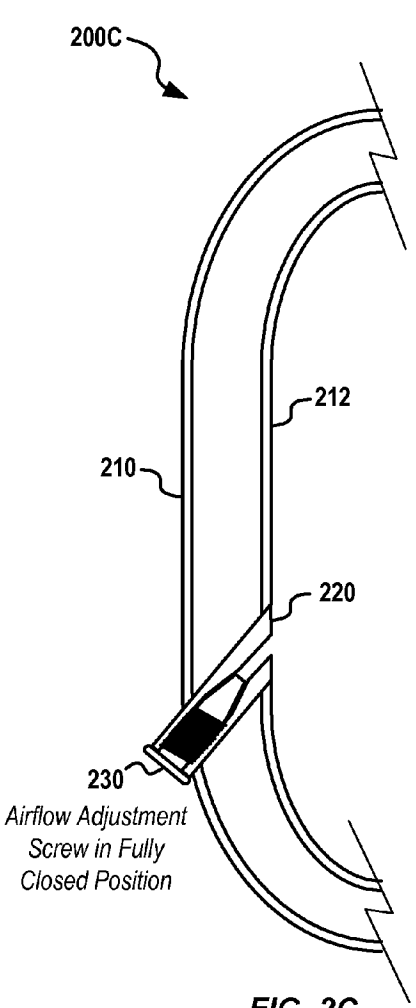
FIGS. 2A-2C illustrate details of an embodiment of a headphone cup including an adjustable airflow valve assembly.
Figure 2B:
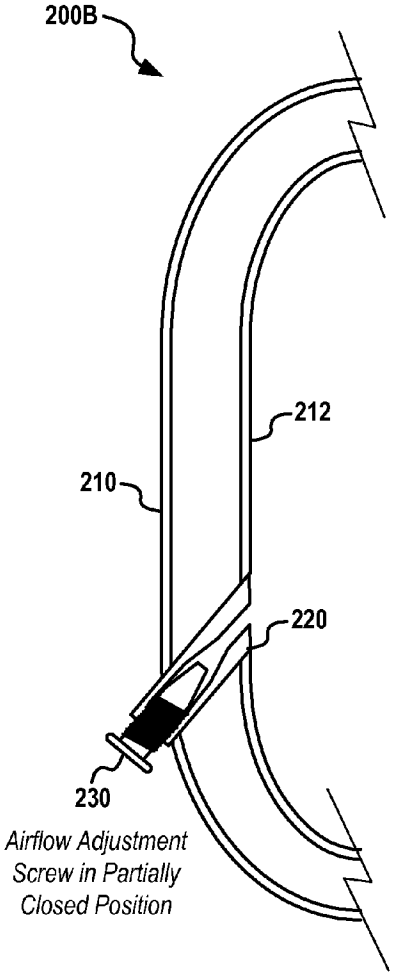
Figure 2A:
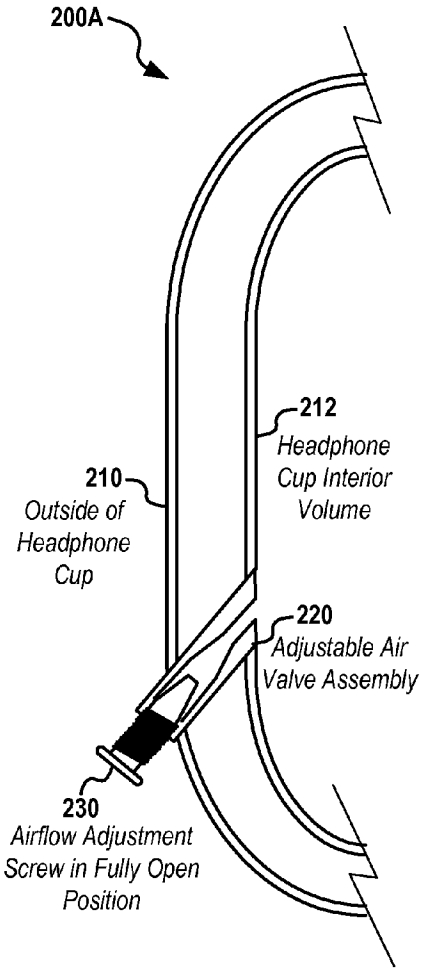

In another aspect, an adjustable airflow valve may be used in various embodiments. For example, FIGS. 2A-2C illustrate details of one embodiment of an adjustable airflow valve assembly 220 including an adjustment screw 230 at various settings 200A-200C. The adjustable valve assembly 220 provides control of airflow between headphone inner volume 212 and the exterior 210. In FIG. 2A, the screw 230 is set in a fully open position to allow maximum airflow between volumes 210 and 212. In FIG. 2B, the screw 230 is set at an intermediate partially closed position to allow less airflow, and in FIG. 2C the screw 230 is set at a fully closed position to isolate the interior volume 212 from the headphone exterior (e.g., creating a closed-ear configuration). Various other adjustment valves may be used in alternate embodiments, and the adjustment valves may be mechanical, electromechanical, or other controlled adjustment elements so adjust airflow and/or interior headphone cup volume (described subsequently).

Figure 3C:
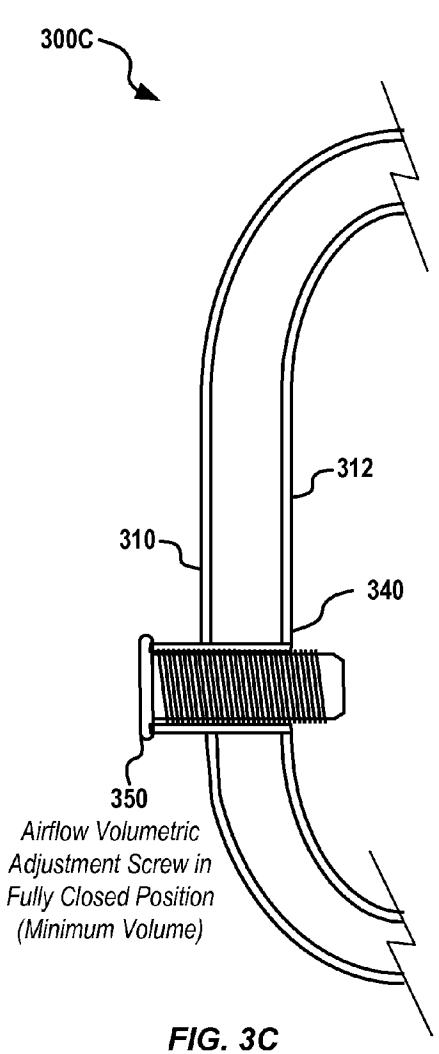
FIGS. 3A-3C illustrate details of an embodiment of a headphone cup including an adjustable cup interior volume assembly.
Figure 3B:
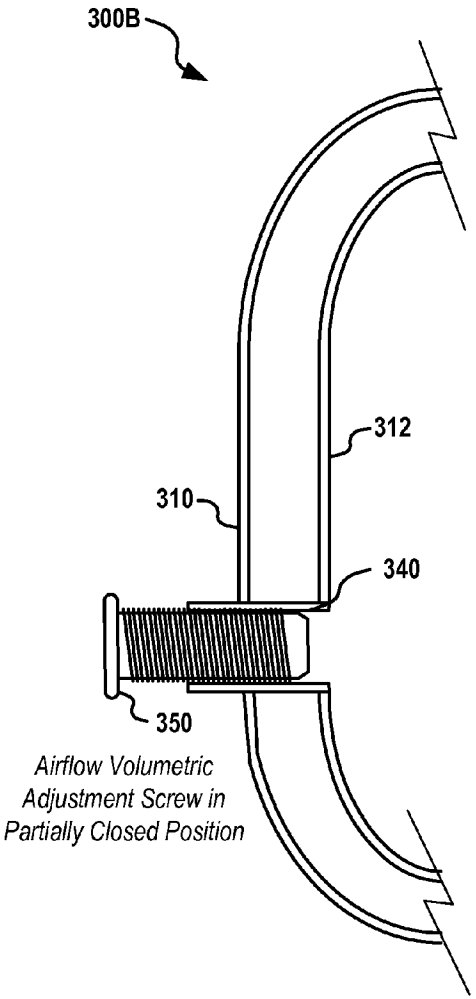
Figure 3A:
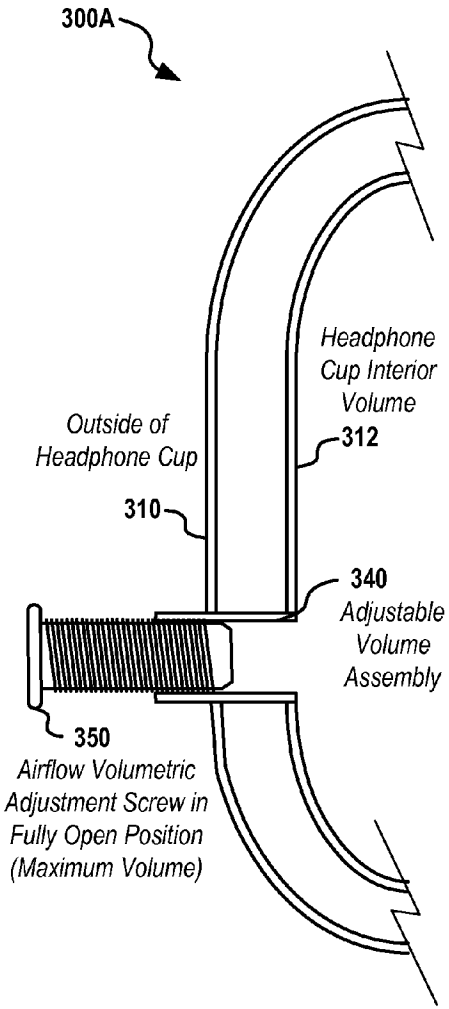

In another aspect as shown in FIGS. 3A-3C, which may be separate from or combined with the adjustable airflow valve embodiment of FIGS. 2A-2C, a headphone may include an adjustable cup interior volume adjustment assembly 340 to provide variation in the internal headphone cup volume (e.g., by varying volume 312 as shown) as shown in volumetric configurations 300A-300C. Any of a variety of mechanisms for adjustably varying the interior headphone cup volume may be used in various embodiments. In the exemplary embodiment of FIGS. 3A-3C, a screw-driven adjustable volume assembly may include a threaded insert 340 and an adjustable screw 350, which may be configured in shape and size to provide a range of volumes for the headphone cup interior. For example, as shown in FIG. 3A, when screw 350 is set to an outermost or fully open position the headphone volume is maximized by including volume with the insert 340 volume. At the intermediate setting shown in FIG. 3B, the volume is adjusted similar to a headphone having a sealed, continuous inner wall surface. In FIG. 3C, in a fully closed screw 350 position, the interior volume 312 is further reduced by having a portion of the screw intrude on the inner volume 312.

In other embodiments, the volume adjustment may not be made with a screw, and may instead be made using 3D printers, where the inside wall is moved away from the outside wall to decrease volume or closer to the outside wall while decreasing the inner matrix to increase enclosure volume during the printing process. Where the Vas of a system warrants a "bigger box," customization may be employed to produce a bigger box to work with the driver.

Figure 4:
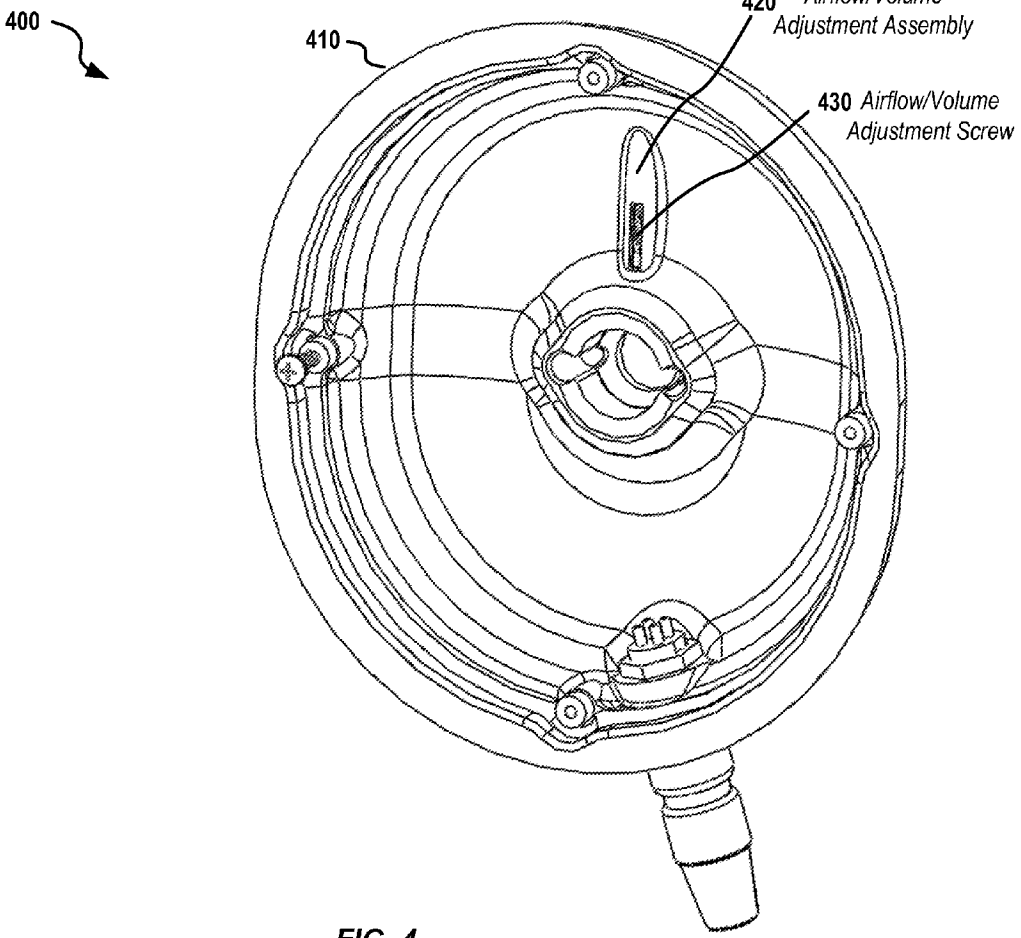
FIGS. 4-8 illustrate details of an embodiment of a headphone cup including an adjustable cup airflow regulation assembly.
Figure 5:
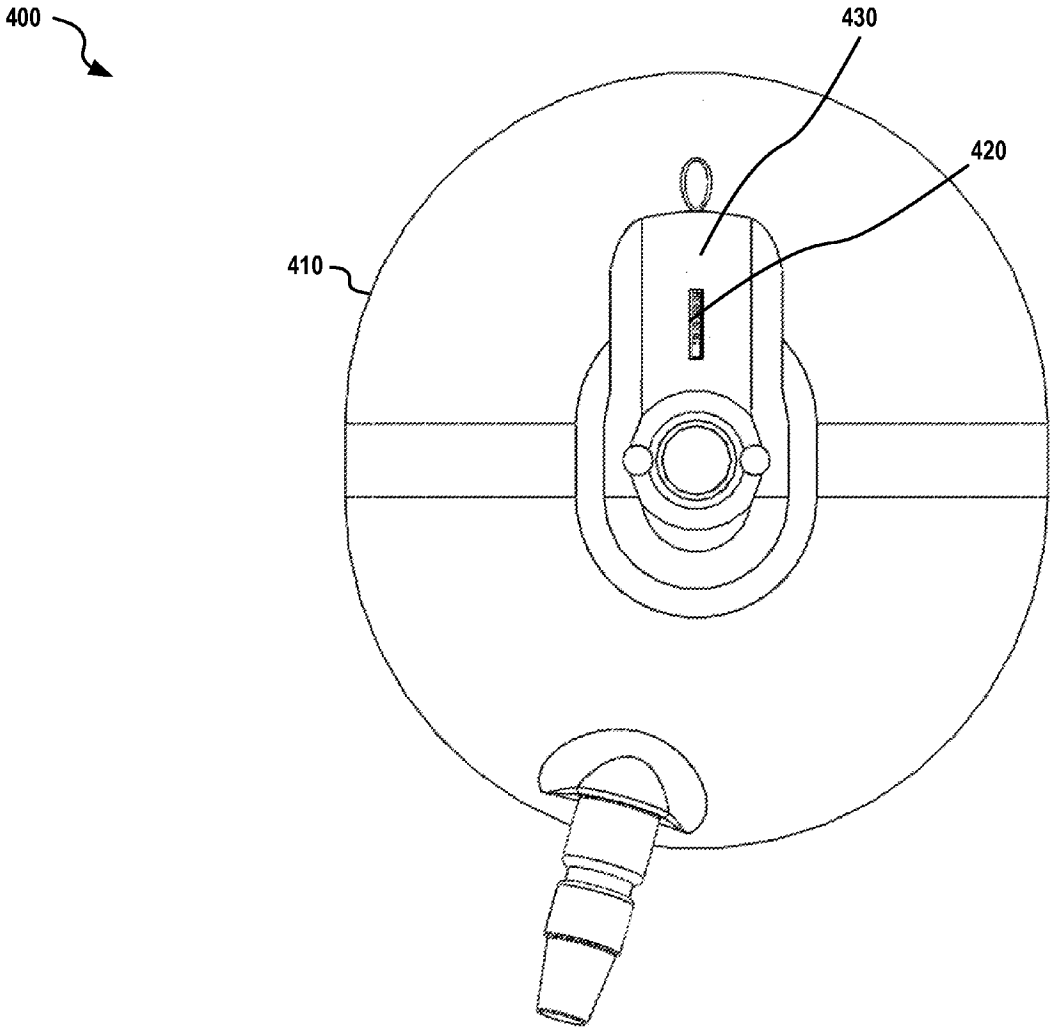
Figure 6:
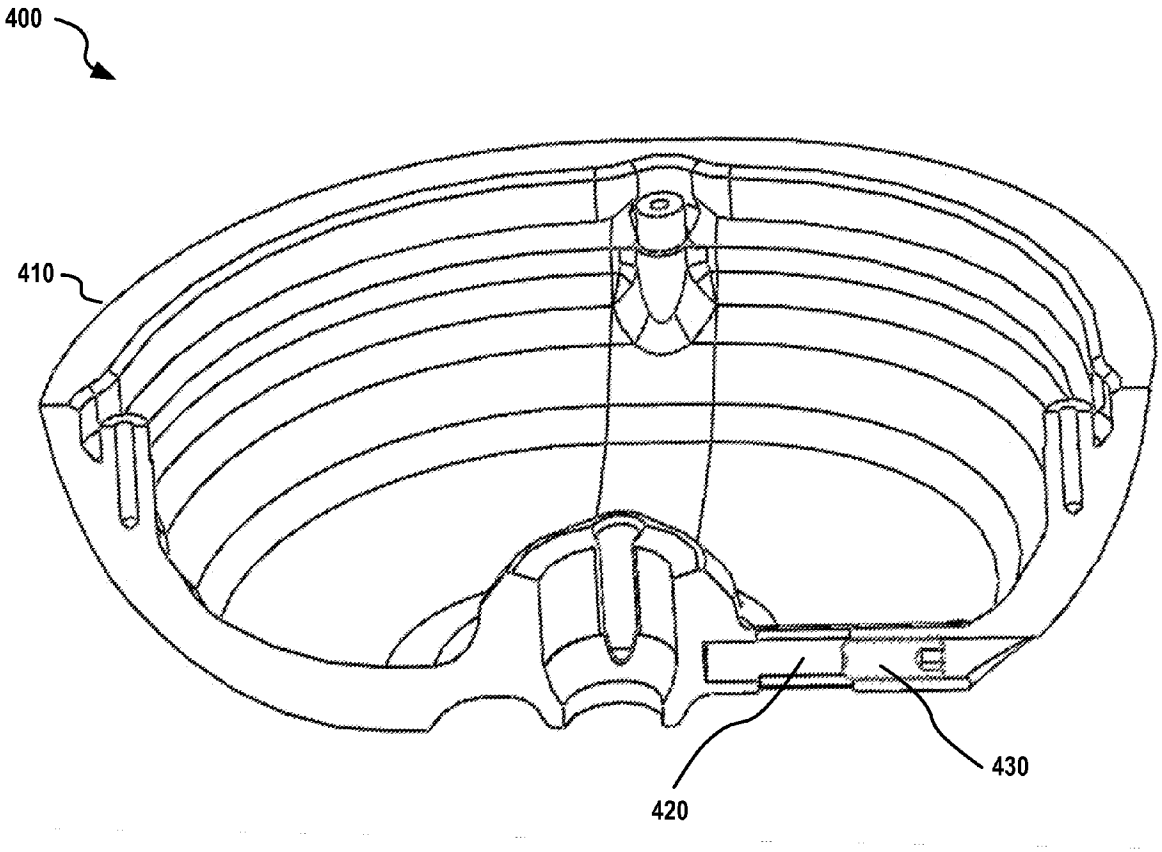
Figure 7:
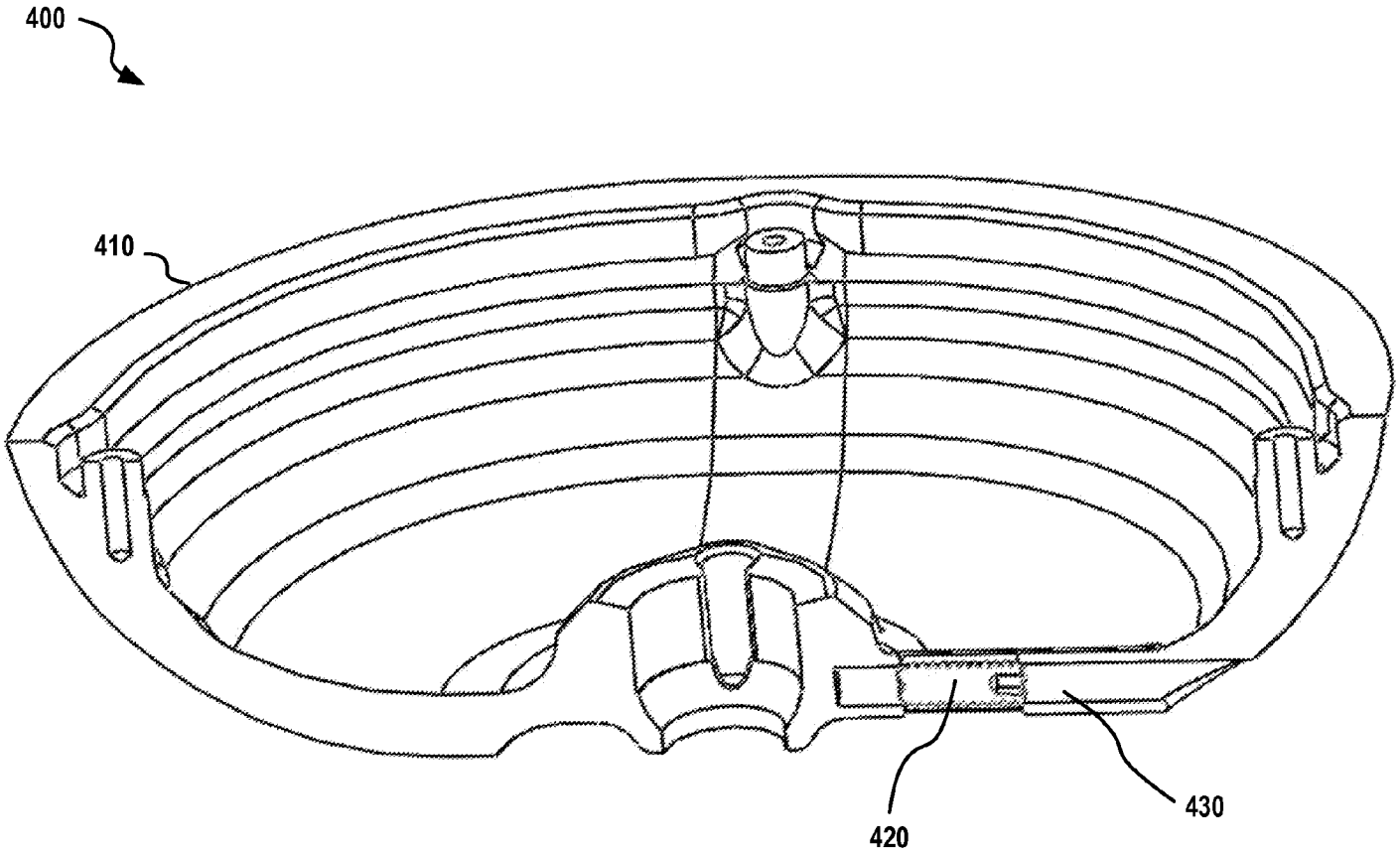
Figure 8:
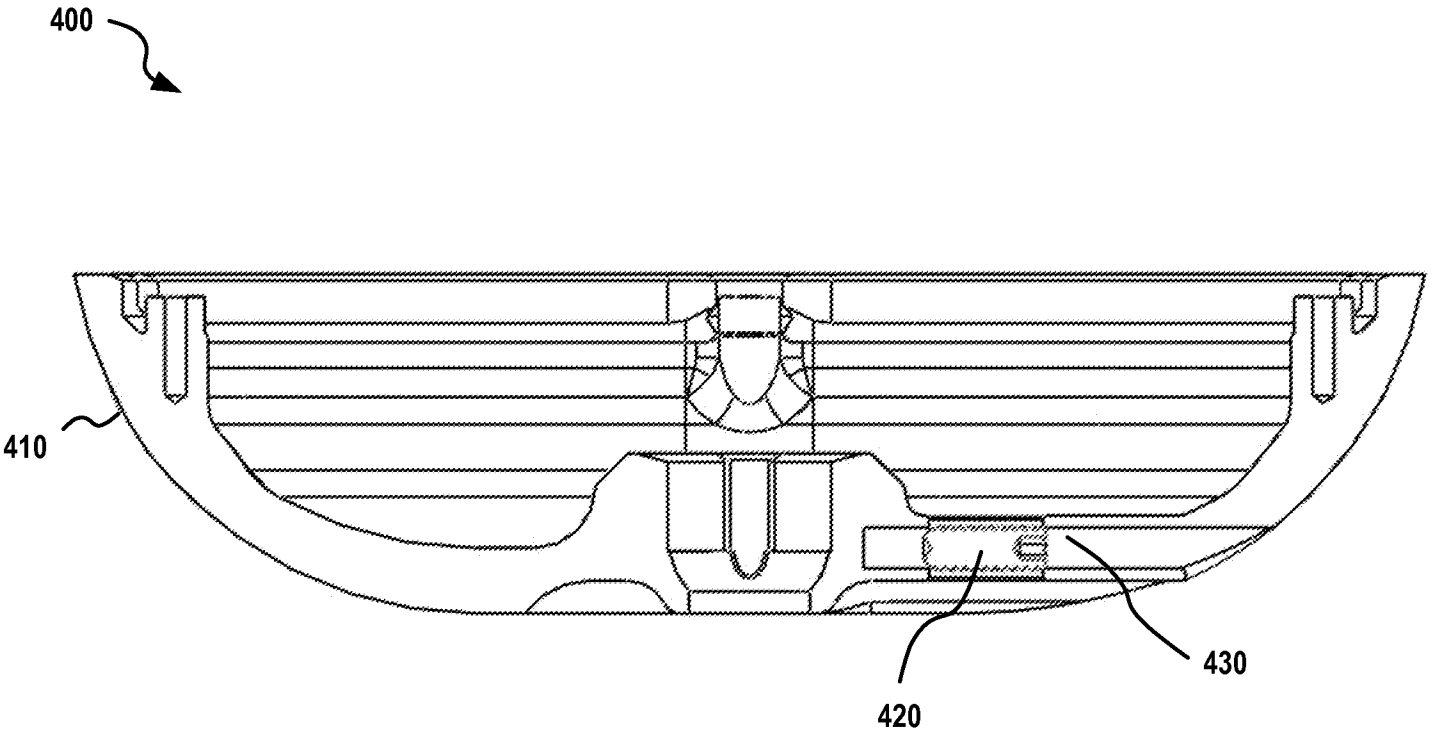

FIGS. 4-8 illustrate details of another exemplary embodiment 400 of a headphone cup including an airflow/volume adjustment valve assembly 830 inset in headphone cup wall 410, with an adjustment screw 420. FIG. 4 shows the cup embodiment 400 from the interior side, while FIG. 5 illustrates the cup from the exterior. FIG. 6 illustrates screw 430 in an open configuration, FIG. 7 illustrates screw 430 in a closed configuration, and FIG. 8 illustrates screw 420 in a closed configuration from a side-cutaway view.

The scope of the presently claimed invention is not intended to be limited to the aspects shown herein, but is to be accorded the full scope consistent with the specification and drawings, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

The previous description of the disclosed aspects is provided to enable any person skilled in the art to make or use embodiments of the present invention. Various modifications to these aspects will be readily apparent to those skilled in the art, and the generic principles defined herein may be applied to other aspects without departing from the spirit or scope of the present invention. Thus, the presently claimed invention is not intended to be limited to the aspects shown herein, but is to be accorded the widest scope consistent with the appended Claims and their equivalents.

I claim:

1. A headphone, comprising:

a cup element including an adjustable airflow valve assembly, wherein the adjustable airflow valve assembly includes an adjustable screw to vary airflow between a headphone cup interior volume and the headphone exterior; and a driver assembly.

2. The headphone of claim 1, wherein the adjustable airflow valve assembly allows continuous adjustment of the airflow.

3. The headphone of claim 1, further comprising a fabric disposed over the adjustable airflow valve assembly selected to adjust a frequency response characteristic of the headphone.

4. The headphone of claim 1, wherein the cup element includes at least one 3D printed element including a plurality of printed layers to operate with a selected headphone driver.

5. A headphone, comprising:

a cup element including an adjustable interior cup volume assembly, the cup including at least one 3D printed element including a plurality of printed layers;

an adjustable airflow valve assembly to vary airflow between a headphone cup interior volume and the headphone exterior; wherein the adjustable interior cup volume assembly includes a screw to adjust the headphone cup interior volume; and a driver assembly.

6. The headphone of claim 5, wherein the adjustable interior cup volume assembly continuously variable adjustment of the headphone cup interior volume.

7. A headphone, comprising:

a cup element including an outer wall, an inner wall, and a matrix disposed between the outer wall and inner wall;

an adjustable airflow valve assembly to vary airflow between a headphone interior volume and the headphone exterior; wherein the adjustable airflow valve assembly includes an adjustable screw to vary airflow between a headphone cup interior volume and the headphone exterior; and a driver assembly.

8. The headphone of claim 7, wherein the outer wall and/or the inner wall comprise a 3D printed structure including a plurality of printed layers.

9. The headphone of claim 7, wherein the matrix comprises a 3D printed structure including a plurality of printed layers.

10. The headphone of claim 7, further including an adjustable interior cup volume assembly.

* * * * *